United States Patent [19]

Murakami

[11] Patent Number: 4,586,911

[45] Date of Patent: May 6, 1986

[54] TRANSFORMABLE TOY VEHICLE

[75] Inventor: Katsushi Murakami, Tokyo, Japan

[73] Assignee: Kabushiki Kaisha Bandai, Tokyo, Japan

[21] Appl. No.: 541,639

[22] Filed: Oct. 13, 1983

[30] Foreign Application Priority Data

| | | | |
|---|---|---|---|
| Jan. 19, 1983 | [JP] | Japan | 58-6911 |
| Feb. 1, 1983 | [JP] | Japan | 58-15065 |
| Mar. 24, 1983 | [JP] | Japan | 58-49337 |

[51] Int. Cl.[4] ..... A63H 3/46; A63H 17/00

[52] U.S. Cl. ..... 446/376; 446/433; 446/465; 446/487

[58] Field of Search ..... 446/93–95, 446/97, 99, 102, 104, 268, 269, 376, 431, 465, 470, 487, 289–291, 433; D21/150, 128, 166

[56] References Cited

U.S. PATENT DOCUMENTS

| | | | |
|---|---|---|---|
| D. 278,643 | 4/1985 | Ogawa | 446/376 X |
| 4,391,060 | 7/1983 | Nakane | 446/94 |
| 4,411,097 | 10/1983 | Murakami | 446/73 |
| 4,516,948 | 5/1985 | Obara | 446/376 X |

FOREIGN PATENT DOCUMENTS

| | | | |
|---|---|---|---|
| 57-5032 | 1/1982 | Japan | 446/291 |
| 58-145694 | 9/1983 | Japan . | |
| 2122908 | 1/1984 | United Kingdom | 446/376 |
| 2128489 | 5/1984 | United Kingdom | 446/95 |

*Primary Examiner*—Mickey Yu

*Attorney, Agent, or Firm*—Armstrong, Nikaido, Marmelstein & Kubovcik

[57] ABSTRACT

A transformable toy vehicle capable of being converted into a toy robot is provided. The converted toy robot gives no impression of the original outer appearance of the toy vehicle, because of the folding operation of the front and rear compartments. The transformable toy vehicle includes a body, a chassis, pivotal members, and wheel support members. The body includes front, middle, and rear compartments. The chassis supports the front and rear compartments and mounts thereupon the vehicle wheels. The front and rear compartments can be rotated about the pivotal member relative to each other to form a trunk body of the toy robot, and the middle compartment is mounted upon the pivotal member to form a head portion of the toy robot. The wheel support member provided with arm or leg member, is pivotally connected to the chassis for rotatably bearing the wheels, and is housed in the recesses formed in the front and rear compartments for pulling out the arm and leg members from the recesses to form arms and legs of the toy robot.

11 Claims, 29 Drawing Figures

1
2
3
4
6
11
21
22

FIG. 10
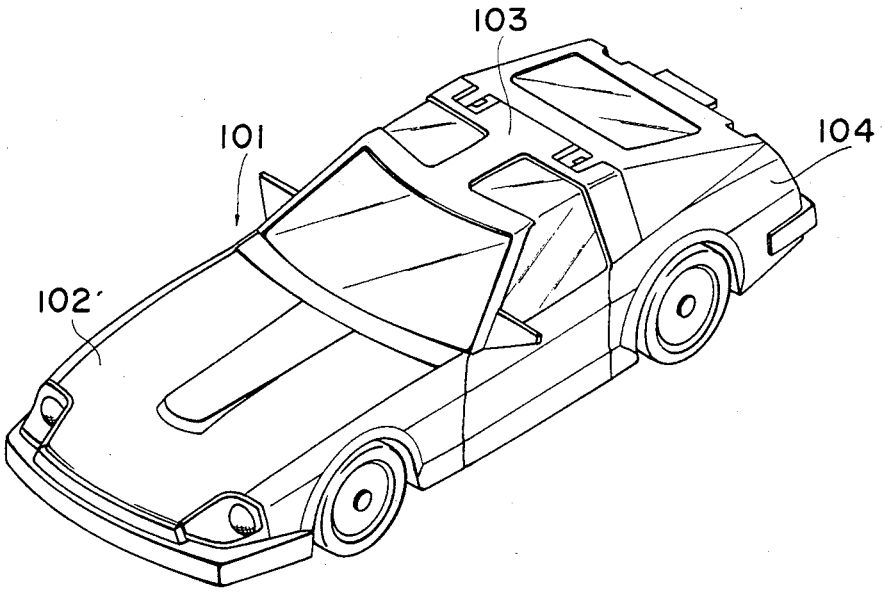
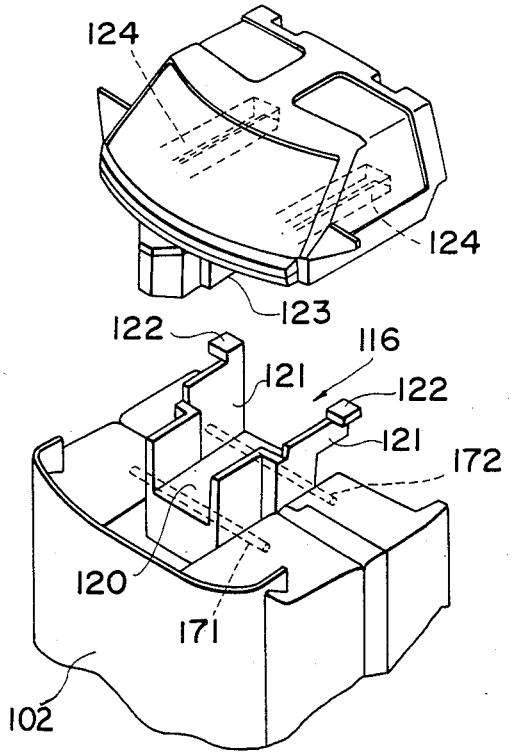
FIG. 12

TRANSFORMABLE TOY VEHICLE

BACKGROUND OF THE INVENTION

The present invention relates to a transformable toy vehicle which can assume the form of two extraordinarily different appearances from each other by converting the mutual arrangement of particular elements constituting the toy vehicle. More in particular, the present invention relates to a transformable toy vehicle, such as a sports car, battle tank or the like which can be easily converted into a toy robot.

There are various kinds of transformable toy vehicles known in the art. Most of such toy vehicles are featured in that the form conversion is mainly restricted only to the change of the outer appearance thereof, the conversion of which is carried out by adding or deleting one or more of the constituting elements of the toy vehicle. Therefore, a toy vehicle of this kind lacks unity as a whole, and is expensive because of an increase of additional elements, when compared with a toy of the kind that can assume the different outer posture from the previous one which was attained by changing the mounting position of the same element or elements without adding or deleting the number of elements constituting the toy.

Transformable toy vehicles the conversion of which can be effected without varying the number of elements, that is, without adding or deleting the constitutional elements, are mostly of the type in which the form of a car is converted into other forms other than that of the car. For example, the form of a sports car is converted into a robot form.

These known transformable toy vehicles converted into a different categories, however, have been found not satisfactory. The form conversion is effected simply by pulling out head, arm, and leg portions of the toy robot from the hollow chamber formed in the toy vehicle. Therefore, it is often true that the degree of form change remains recognized only a little and the converted toy robot has still some impression causing children playing with it to remind of the outer appearance of the original toy vehicle, thus, necessarily leading to wanting in interest for children.

SUMMARY OF THE INVENTION

It is, therefore, a principal object to provide a transformable toy vehicle which can assume remarkably different two outer appearances, without giving any impression of the outer appearance of the original posture. In order to carry out the above object, according to one aspect of the present invention, a transformable toy vehicle capable of being converted into a toy robot is provided which comprises: a body having front, middle, and rear compartments; a chassis for supporting the front and rear compartments and for mounting vehicle wheels thereupon; a pivotal member about which the front and rear compartments can be rotated relative to each other to form a trunk body of the toy robot and upon which the middle compartment is mounted to form a head portion of the toy robot; and a wheel support member pivotally connected to the chassis for rotatably bearing the wheel, the wheel support member is provided with arm and leg members which are housed in respective recesses formed in the front and rear compartments for ejecting the arm and leg members therefrom to form arms and legs of the toy robot.

According to another aspect of the present invention, a transformable toy vehicle capable of being converted into a toy robot is provided which comprises: a body having front, middle, and rear compartments; a chassis for supporting the front and rear compartments and for mounting vehicle wheels, a pivotal member about which the front and rear compartments can be rotated relative to each other to form a trunk body of the toy robot; means coupled between the front and rear compartments for mounting the middle compartment which serves as a head portion of the toy robot; a wheel support member connected to the chassis for supporting the vehicle wheels, the vehicle wheels serving as legs of the toy robot when the vehicle wheels are turned about the support member; and an arm support member which is mounted on one of the front and rear compartments, and is provided with respective arm members which are housed in a recess of the one of front and rear compartments for ejecting the arm member therefrom to form arms of the toy robot.

The foregoing objects and other objects of the present invention as well as the structure characteristic of the invention, and modifications and improvements thereto, become more apparent to the reader from a consideration of the detailed description of the preferred embodiments of the invention which follows, taken together with the illustrations thereof presented in the accompanying figures of the drawings.

BRIEF DESCRIPTION OF THE DRAWINGS

In the drawings:

FIG. 10 is a perspective view of a sports car capable of being converted into a toy robot, according to a fourth embodiment of a transformable toy vehicle of the present invention;

FIG. 12 is a partial exploded view showing the mounting of a middle compartment upon a pivotal member and its sliding engagement mechanism relative to front and rear compartments, in accordance with the fourth embodiment;

DETAILED DESCRIPTION OF THE PREFERRED EMBODIMENTS

A more detailed description of the embodiments of the present invention will now be given in conjunction with the accompanying drawings.

Figure 1:
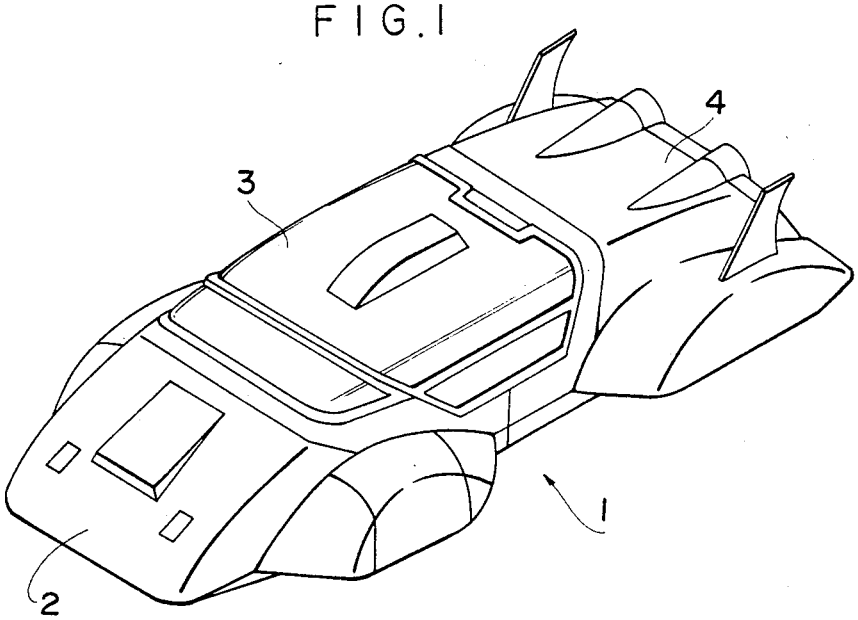
FIG. 1 is a perspective view of a sports car capable of being converted into a toy robot, according to a first embodiment of a transformable toy vehicle of the present invention.
Figure 2:
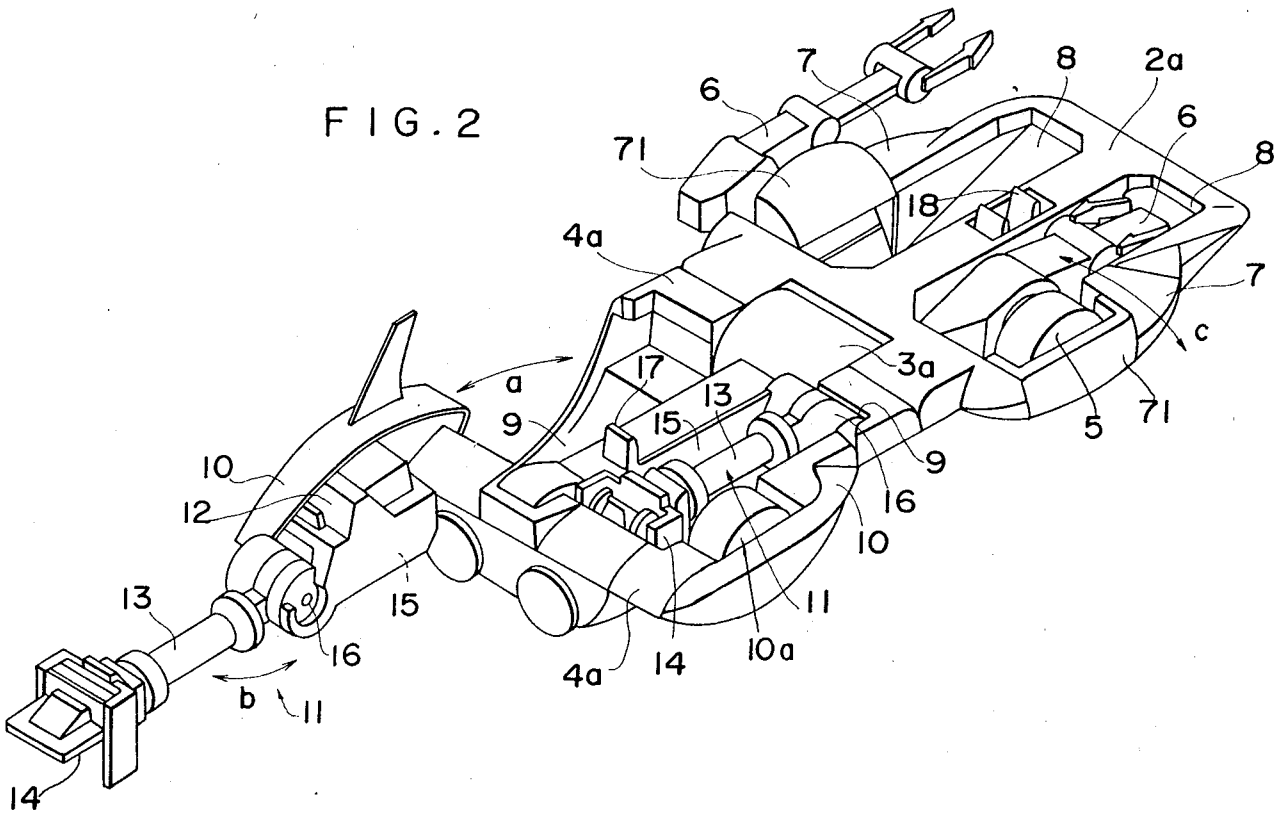
FIG. 2 is a perspective view of the transformable toy vehicle of FIG. 1 which is turned upside down and one of the arms is pulled out, and one of the legs is stretched out.

FIGS. 1 to 5*c* show a first embodiment of the transformable toy vehicle according to the invention. FIG. 1 is a perspective view of a transformable toy vehicle 1. The vehicle body comprises a front compartment or bonnet 2, a middle compartment 3 for a driver, and a rear compartment or trunk 4. The vehicle body can be supported by a chassis comprising a front chassis 2*a* (FIG. 2) and a rear chassis 4*a* (FIG. 2). In this embodiment, the chassis is integrally formed with the front compartment 2 and the rear compartment 4. Both compartments 2 and 4 are so constructed, as is later described, to be capable of being folded, with both bottom sides or corresponding chassis confronting with each other.

FIG. 2 is a view seen from the bottom of the transformable toy vehicle shown in FIG. 1. As seen from FIG. 2, a pair of front wheels 5,5 are respectively and rotatably mounted on a portion of the front chassis 2*a* which constitutes a front fender 7. A section of the front fender 7, that is, front wheel support member 71 is provided with the front wheel 5, and can be rotated as shown in the arrow c in FIG. 2. Thus, the front wheel support member 71 can be turned inside out for pulling out arms 6,6 from recesses 8 formed in the front compartment 2. The arm 6 is pivotally connected to the front wheel 5 so that the arm can be rotated around the wheel 5.

A pair of rear fenders, that is, rear wheel support members 10 is rotatably connected to the rear chassis 4*a* at the rear portion thereof so that the rear wheel support members 10 can be rotated frontside back as shown by an arrow a in FIG. 2. A leg member 11 is rotatably connected at the front portion of the rear fender 10 opposite the rear portion of the chassis 4*a*, and is housed within recess 9 formed in the rear compartment 4. The leg member 11 comprises an upper leg 12, a lower leg 13, and a foot 14. The lower leg 13 and the foot 14 can be rotated around an axle 16, as shown by an arrow b, so that the leg 13 and the foot 14 can be accommodated within a recess 15 formed in the upper leg 12. The rear wheel support member 10 with a rear wheel 10*a* rotatably connected thereto and the leg member 11, are housed in the recess 9 formed in the rear compartment 4.

A projecting member 17 integrally mounted on the rear chassis 4*a* can be engaged with an engaging recess 18 formed integrally with the front chassis 2*a*. Thus, the projecting member 17 and the engaging recess 18 can serve as a snap joint for ensuring the abutment of the front compartment 2 and the rear compartment 4 when both compartments are folded.

Figure 3:
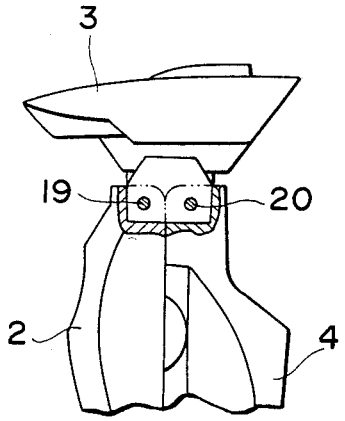
FIG. 3 is a partial view showing the mounting of a middle compartment upon a pivotal member relative to front and rear compartments in accordance with the first embodiment.

A pivotal member 3*a* is connected between the front chassis 2*a* and the rear chassis 4*a* by means of two axles 19 and 20 (see FIG. 3). The middle compartment 3 is fixedly connected upon the pivotal member 3*a* as shown in FIG. 3. The middle compartment 3 serves as a head portion of the toy robot converted, and the axle 19 pivotally supports the front compartment or bonnet 2, and the axle 20 pivotally supports the rear compartment or trunk 4.

Figure 4:
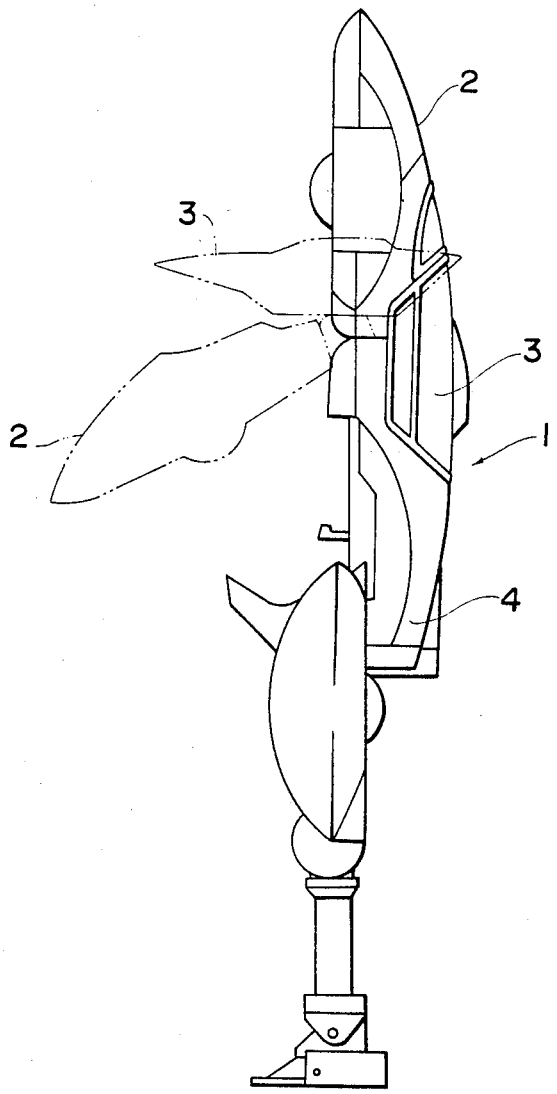
FIG. 4 is a side elevational view of the transformable toy vehicle according to the first embodiment, in which the toy vehicle rests upon the stretched legs, and in which folding operation of the front compartment toward the rear compartment is shown by phantom lines.
Figure 5C:
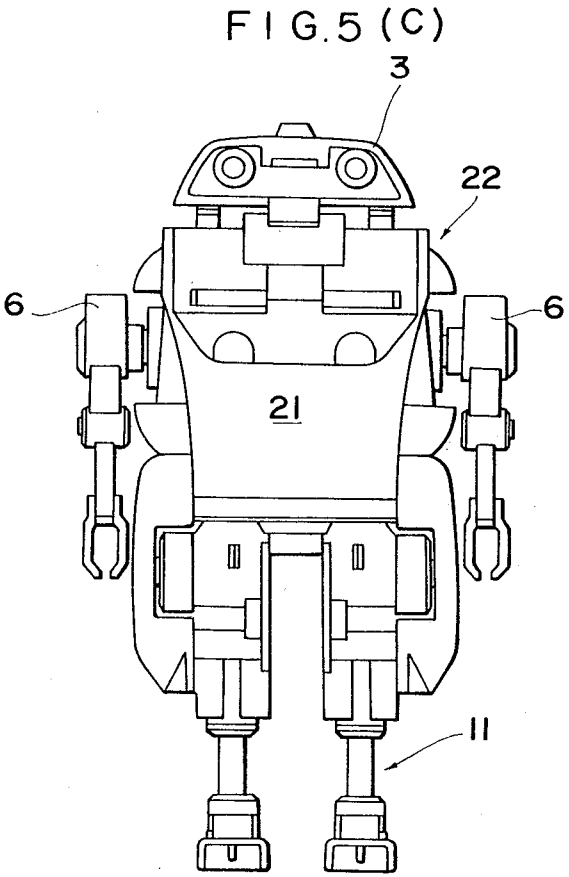
FIGS. 5*a* to 5*c* are respectively rear, side, and front elevational views of the toy robot changed from the toy vehicle according to the first embodiment.
Figure 5B:
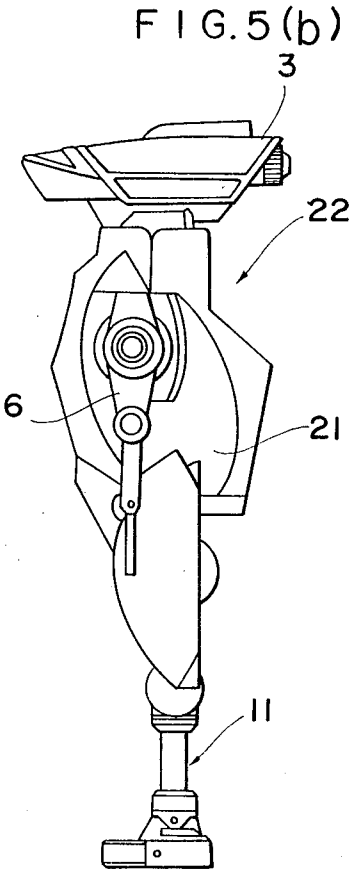
Figure 5A:
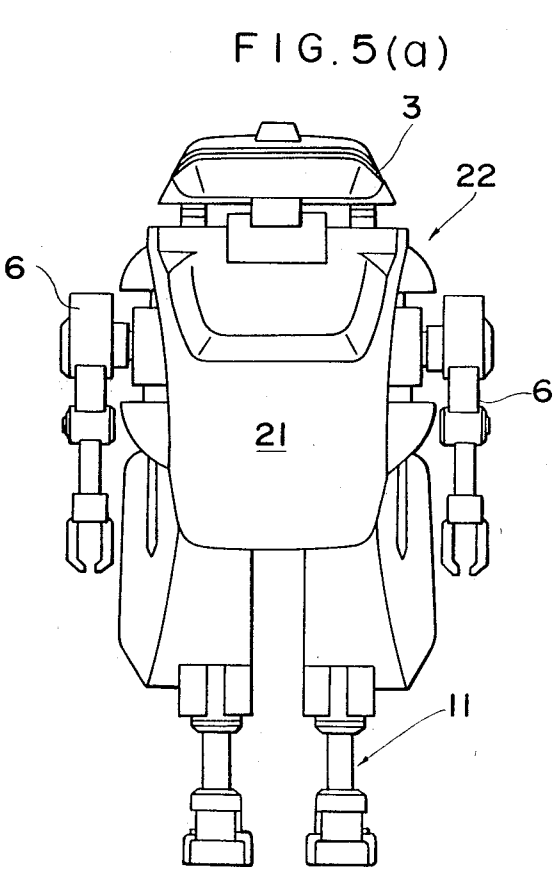

The operation of the transformable toy vehicle thus constructed will now be described in conjunction with FIGS. 4 to 5*c*, wherein the conversion from the sports car to the toy robot is carried out.

First, both arm members 6 are pulled out from the recess 8 as previously described with reference to the arrow c of FIG. 2. And then, the lower legs 13 with the feet 14 are rotated about the axle 16 for stretching out of the recess 9 of the upper leg 12, thereafter the upper legs 12 are turned about for stretching out from the recess 9. In this condition, the transformable toy vehicle 1 is converted into the posture shown in FIG. 4. The conversion operation is continued by folding the front and rear compartments 2 and 4 about the axles 19 and 20 as partially shown in FIG. 4 by a phantom line, until the mutual engagement, between the projecting member 17 and the engaging recess 18, can be retained. In this condition, the transformable toy vehicle 1 is converted into the posture shown in FIGS. 5*a* to 5*c*, that is, a toy robot. As is readily understood, the front and rear compartments 2 and 4 serve as a trunk portion 21 of the toy robot 22. The inverse transformation of the toy robot 22 into the original toy vehicle can be carried out by reversing the above described form conversion operation.

It is seen from the above description that the change of the outer appearance is appreciable and there is nothing which gives impression of the original outer appearance. This is due mainly from the fact that the trunk of the toy robot is made from the front and rear compartments.

Figure 7:
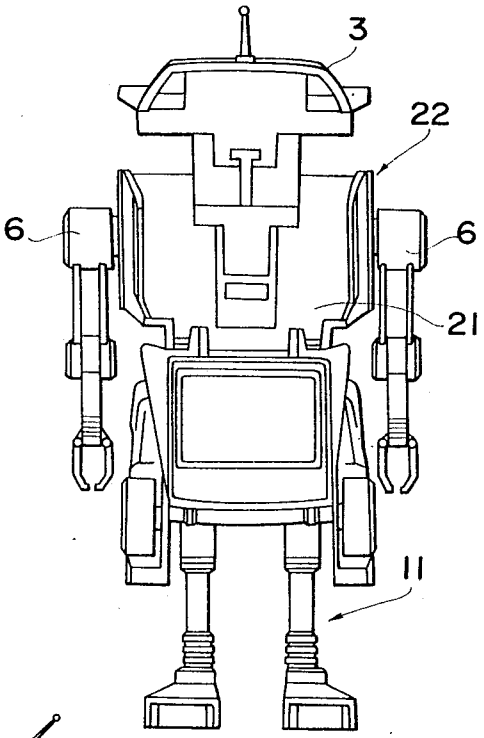
FIGS. 7*a* to 7*c* are respectively rear, side, and front elevational views of the toy robot changed from the toy vehicle according to the second embodiment of FIG. 6.
Figure 7:
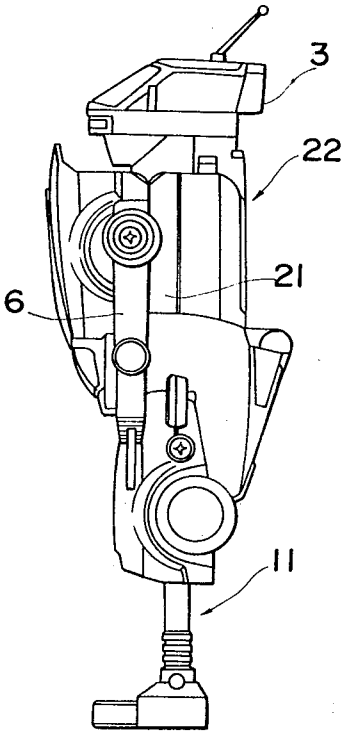
Figure 7:
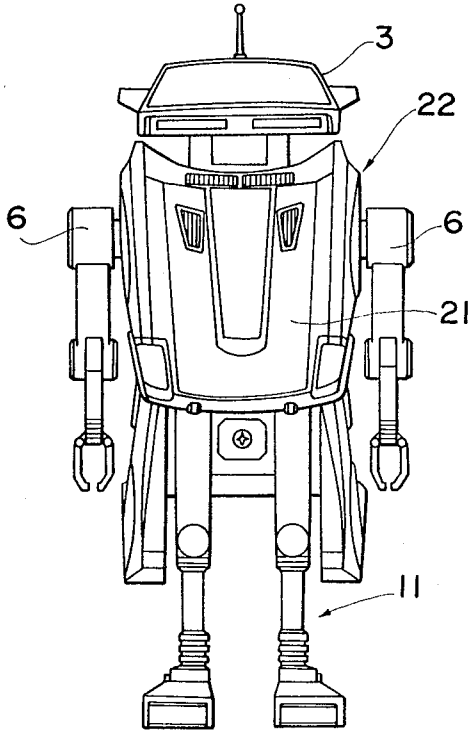
Figure 6:
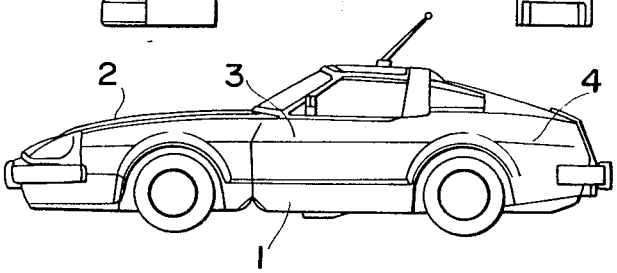
FIG. 6 is a side elevational view of a sports car capable of being converted into a toy robot, according to a second embodiment of a transformable toy vehicle of the present invention.
Figures 8, 9A, 9B, 9C:
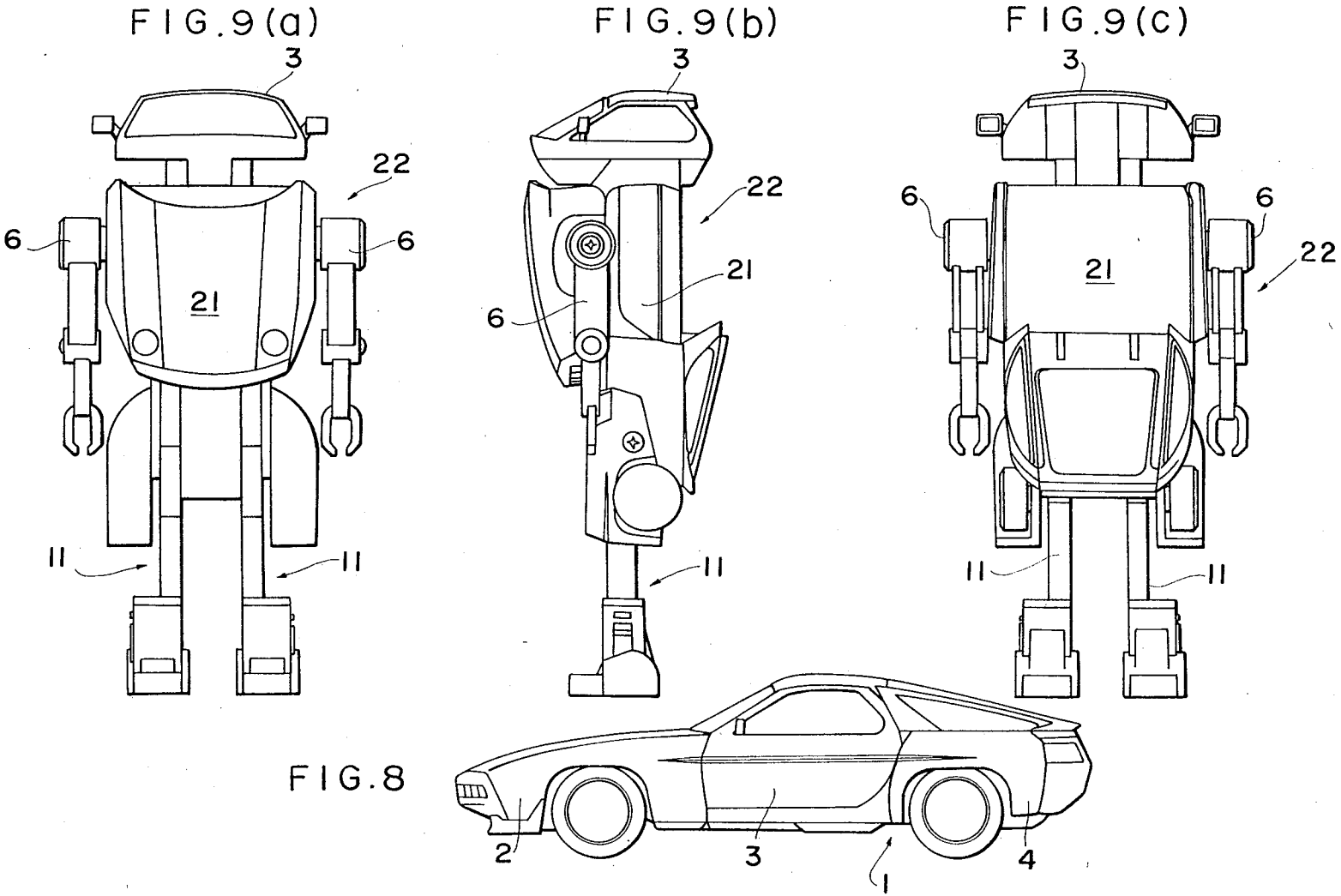
FIG. 8 is a side elevational view of a sports car capable of being converted into a toy robot, according to a third embodiment of a transformable toy vehicle of the present invention.
FIGS. 9*a* to 9*c* are respectively rear, side, and front elevational views of the toy robot changed from the toy vehicle according to the third embodiment of FIG. 8.

FIGS. 6 to 7*c* show a second embodiment of the transformable toy vehicle according to the present invention. FIGS. 8 to 9*c* show a third embodiment of the transformable toy vehicle according to the present invention. The construction and the conversion operation of the second and third embodiments are the same as those of the first embodiment, except that minor outer decorative appearances have been changed. Therefore, the description of the second and third embodiments is omitted for the purpose of brevity, only however by identifying the corresponding elements to those of the first embodiment by using the same reference numbers.

It is to be understood that although the arm is housed in the recess of the front compartment and the leg is housed in the recess of the rear compartment, it is not to be limited to such arrangement and the leg can be housed in the front compartment and the arm can be housed in the rear compartment. Furthermore, the pivotal member with two axles can be replaced for a pivotal member with one axle connecting either one of the front and rear chassis, whereby the head portion of the toy robot can be swingable, relative to the trunk of the toy robot.

Figure 11:
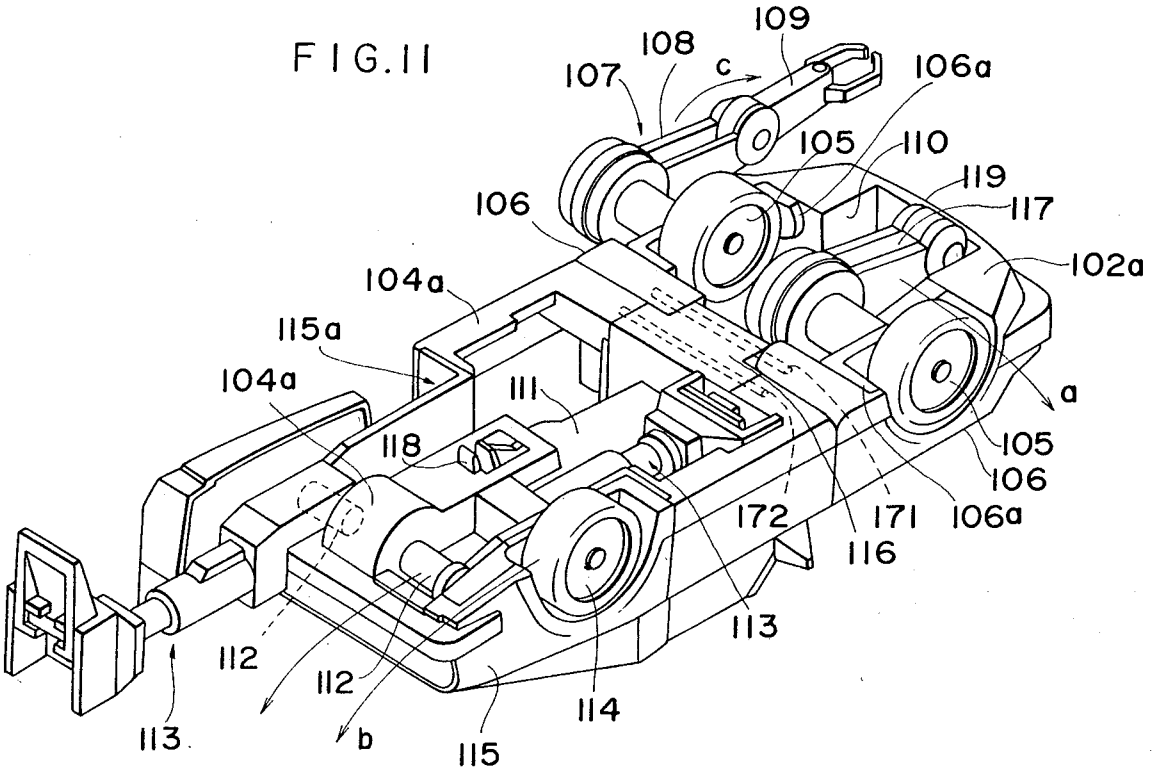
FIG. 11 is a perspective view of the transformable toy vehicle shown in FIG. 10 which is turned upside down and one of the arms is pulled out, and one of the legs is stretched out.

FIGS. 10 to 15 show a fourth embodiment of the transformable toy vehicle according to the invention. FIG. 10 is a perspective view of a transformable toy vehicle 101. The vehicle body comprises a front compartment or bonnet 102, a middle compartment 103 for a driver, and a rear compartment or trunk 104. The vehicle body can be supported by a chassis comprising a front chassis 102*a* (FIG. 11) and a rear chassis 104*a* (FIG. 11). In this embodiment, the chassis is integrally formed with the front compartment 102 and the rear compartment 104. Both compartments 102 and 104 are so constructed, as is later described, to be capable of being folded with both bottom sides or corresponding chassis confronting with each other.

FIG. 11 is a view seen from the bottom of the transformable toy vehicle shown in FIG. 10. As seen from FIG. 11, a pair of front wheels 105 are respectively and rotatably mounted on front wheel support members 106*a* which is mounted on the front chassis 102*a* for pivotal movement of about 180 degrees toward the outside of the vehicle 101, relative to front fenders 106, thereby enabling being rotated as shown in arrow a in FIG. 11. Thus, the front wheel support member 106*a* can be turned inside out for pulling out or ejecting arms 107 from recesses 110 formed in the front compartment 102. The arm 107 is comprised of an upper arm 108 and a lower arm 109. The arm 107 can be housed in the recess 110 by folding the lower arm 109 upon the upper arm 108. The arm 107 is pivotally connected to the front wheel support member 106*a* so that the arm can be rotated relative to the vehicle body 101.

A pair of rear fenders, that is, rear wheel support members 115 is rotatably connected through an axle 112 to the rear chassis 104*a*, so that the rear wheel support member 115 can be rotated frontside back about 180 degrees as shown by an arrow b shown in FIG. 11. The rear fender or rear wheel support member 115 is housed in a recess 115*a* formed on the rear compartment 104. A leg 113 is also rotatably connected to the axle 112 and can be folded about 180 degrees to be housed in a recess 111 formed in the rear compartment 104.

An engaging member 118 formed upon the rear chassis 104*a* can be locked at a front end protrusion 119 of a front chassis 102*a*. Thus, the engaging member 118 and the front end protrusion 119 can serve as a snap joint for ensuring the abutment of the front compartment 102 and the rear compartment 104 when both compartments are folded.

A pivotal member 116 is connected between the front chassis 102*a* and the rear chassis 104*a* by means of two axles 171 and 172. FIG. 12 is a perspective exploded view of the front and rear compartments 102 and 104 folded relative to each other, and the arrangement of the pivotal member 116 and the middle compartment 103 of the toy robot. The pivotal member 116 is provided with a channel 120 centrally thereof. A projection 122 is provided on the top of side walls 121. An engaging neck portion 123 is extended beneath the middle compartment 103. A groove 124 is formed on the bottom surface of the middle compartment 103 in parallel with the side surface of the engaging neck portion 123. The neck portion 123 is adapted to be housed in the channel 120, while the projection 122 is adapted to be housed in the groove 124. Therefore, the middle compartment 103 is mounted on the pivotal member 116 in such a manner that the former can be moved slidably upon the pivotal member 116. The range of the movement of the middle compartment 103 relative to the pivotal member 116 is decided by the length of the groove 124 which abuts at both ends thereof against the projection 122.

Figure 13:
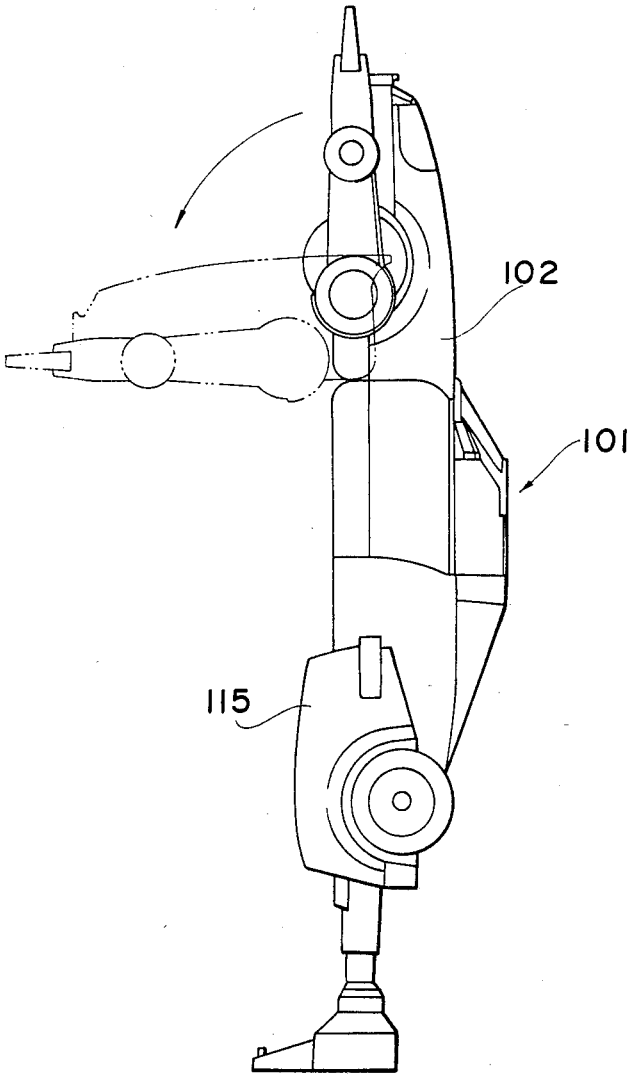
FIG. 13 is a side elevational view of the transformable toy vehicle according to the fourth embodiment, in which the toy vehicle rests upon the stretched legs, and in which folding operation of the front compartment toward the rear compartment is shown by phantom lines.
Figure 15:
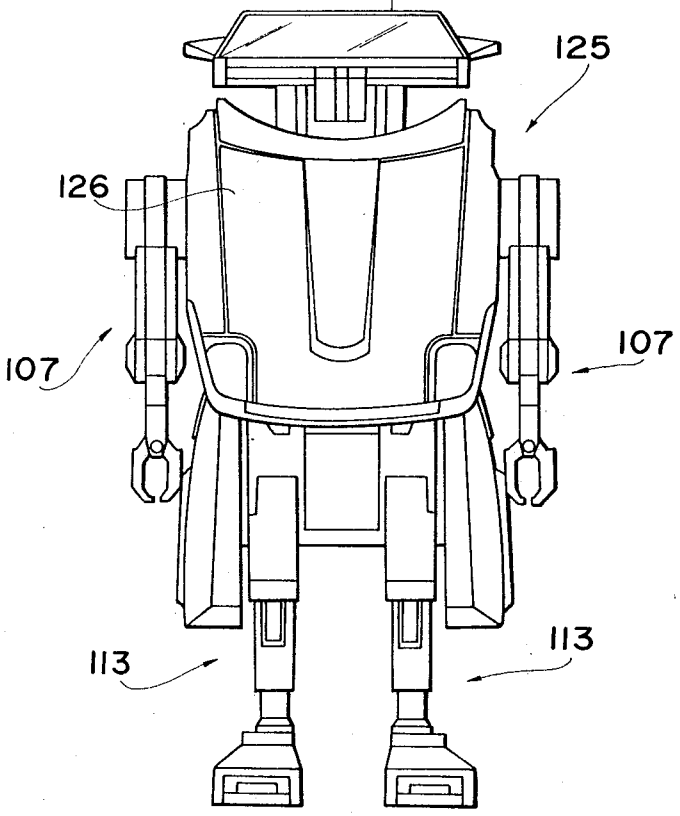
FIG. 15 is a front elevational view of the form converted toy vehicle shown in FIG. 10 into a toy robot.
Figure 14:
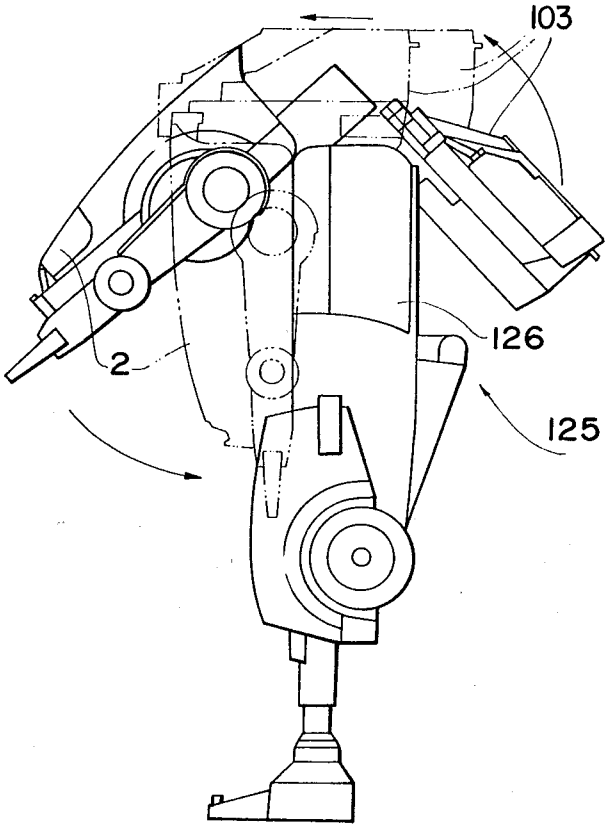
FIG. 14 is a side elevational view of the transformable toy vehicle according to the fourth embodiment, in which the toy vehicle rests upon the stretched legs, and in which sliding operation of the middle compartment toward the front of the vehicle is shown by phantom lines from its rear position to its front position.

The operation of the transformable toy vehicle thus constructed will now be described in conjunction with FIGS. 13 to 15, wherein the conversion from the sports car to the toy robot is carried out.

First, both arm members 107 are turned inside out so as to be pulled out from the recesses 110 as shown in FIG. 11 by an arrow a. Then, the lower arms 109 are stretched out from the upper arms 108 as shown by an arrow c, and both legs 113 are turned around the axles 112 about 180 degrees in order to pull out from the recesses 111, thereby resulting in the posture as shown in FIG. 13 by a solid line, with the rear wheel support members 115 turned about 180 degrees along the body side face. The next operation of the conversion is carried out by folding the front compartment 102 about the axles 171 and 172, until the engaging member 118 locks at the front end protrusion 119. As a result, as shown in FIG. 14 by a phantom line, the front compartment 102 and the rear compartment 104 in combination constitute a trunk portion 126 of the toy robot 125. In this condition, since the middle compartment 103 is located backward relative to the trunk portion 126, the middle compartment 103 is slided forward through the pivotal member 116, until it stops by abuting against the front end surface of the grooves 124. Thus, the middle compartment 103 is suitably located upon the trunk portion 126 to simulate the head portion 103 of the toy robot 125 as shown in FIG. 15. The inverse transformation of the toy robot 125 into the original toy vehicle can be carried out by reversing the above described form conversion operation.

Figure 16:
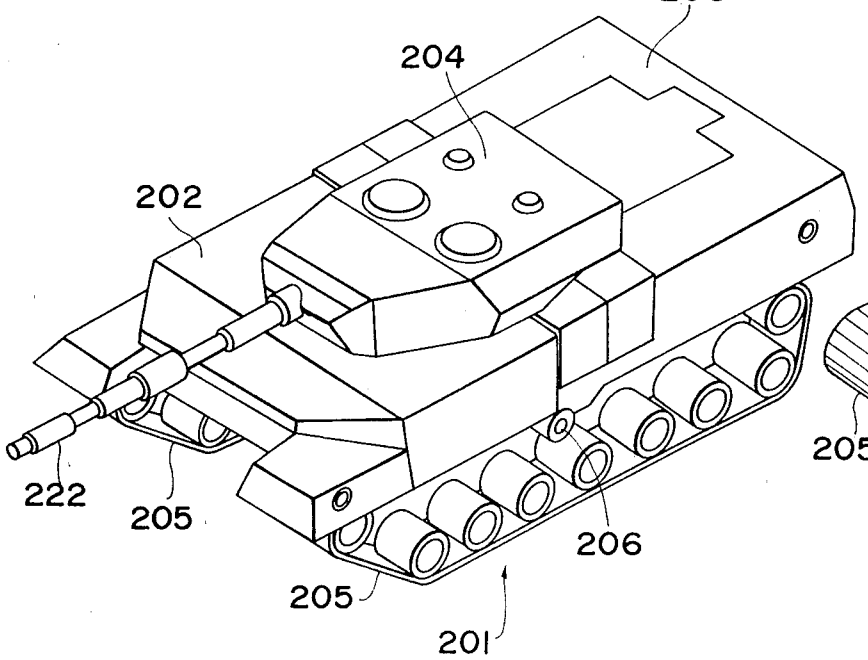
FIG. 16 is a perspective view of a battle tank capable of being converted into a toy robot, according to a fifth embodiment of a transformable toy vehicle of the present invention.

It is seen from the above description that the change of the outer appearance is appreciable and there is nothing which gives impression of the original outer appearance. This is due mainly from the fact that the trunk of the toy robot is made from the front and rear compartments. The quite different postures enhance its play value, but the toy vehicle comprises a relatively small number of components, which is obviously advantageous for production and assembly. FIGS. 16 to 23 show a fifth embodiment of the transformable toy vehicle according to the invention. FIG. 16 is a perspective view of a transformable toy vehicle or in this embodiment a toy battle tank 201. The vehicle body comprises a front compartment 202, a middle compartment for a driver 204 and a rear compartment 203. The front and rear compartments 202 and 203 are so constructed, as is later described, to be capable of being folded with bottom side faces thereof being confronted with each other. The front and rear compartments 202 and 203 are supported by a pair of chassis described later. The middle compartment 204 is mounted upon the front and rear compartment 202 and 203 by means of a coupling device described later. A caterpillar 205 is supported by the chassis, and a cannon 222 is provided on the middle compartment 204.

Figure 17:
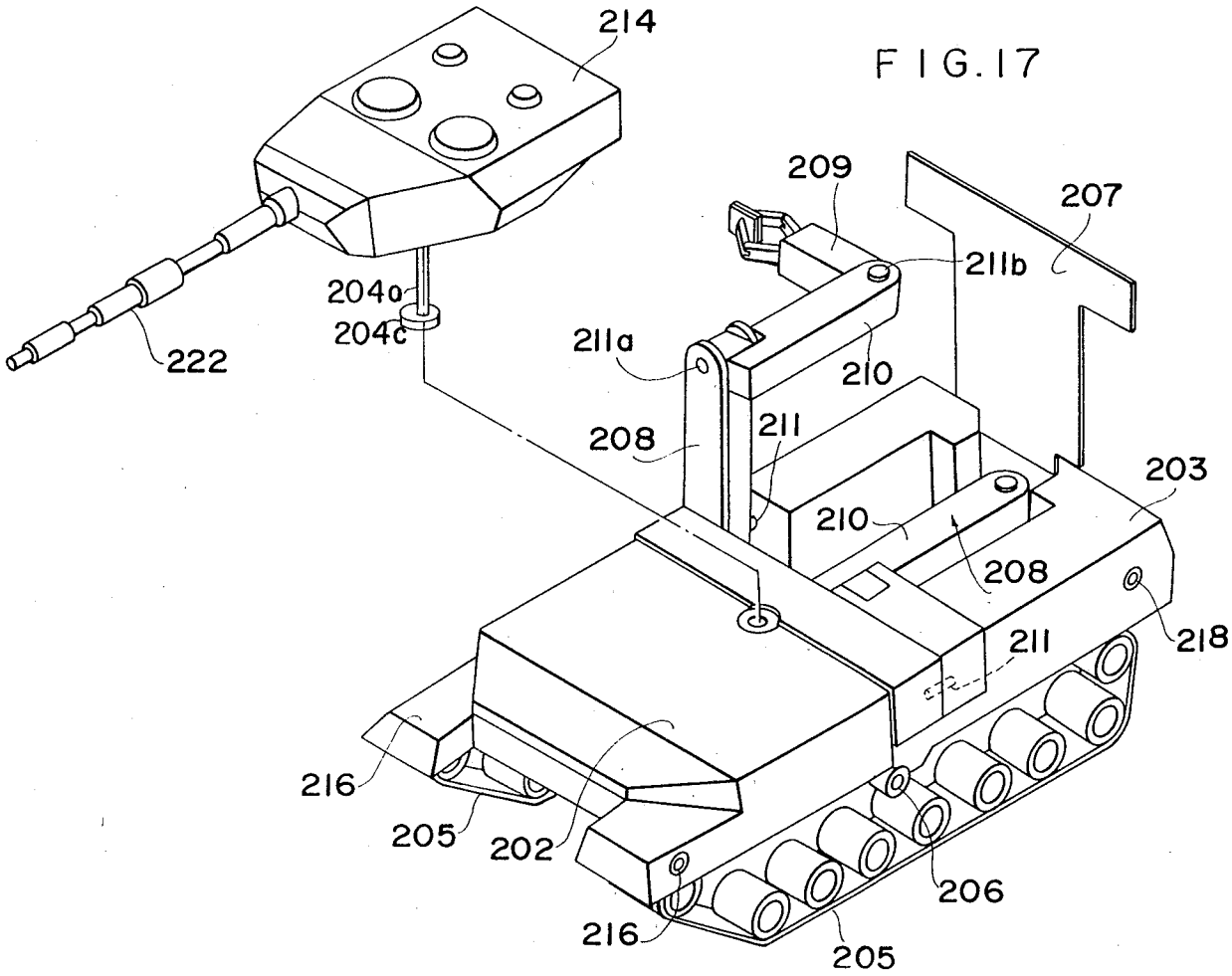
FIG. 17 illustrates how an arm assembly is pulled out from the recess formed in the rear compartment of the battle tank shown in FIG. 16.

The rear compartment 203 is provided with a lid 207 as shown in FIG. 17. The lid 207 is hinged to the body of the rear compartment 203, and can be opened in order to pull out from a recess formed therein arm support members 208, upper arms 210, and lower arms 209. The arm support member 208 is connected to the rear compartment 203 by means of a pin 211 for rotational movement thereabout. The upper arm 210 is connected to the arm support member 208 by means of a pin **211*a* for rotational movement thereabout. The lower arm 209 with a hand is connected to the upper arm 210 for rotational movement thereabout, and can be accommodated within a recess formed in the upper arm 208. Thus, the lower and upper arms 209 and 210 can be housed in the recess of the rear compartment 203 by rotating the arm support member 208 about the pin 211**.

Figure 18:
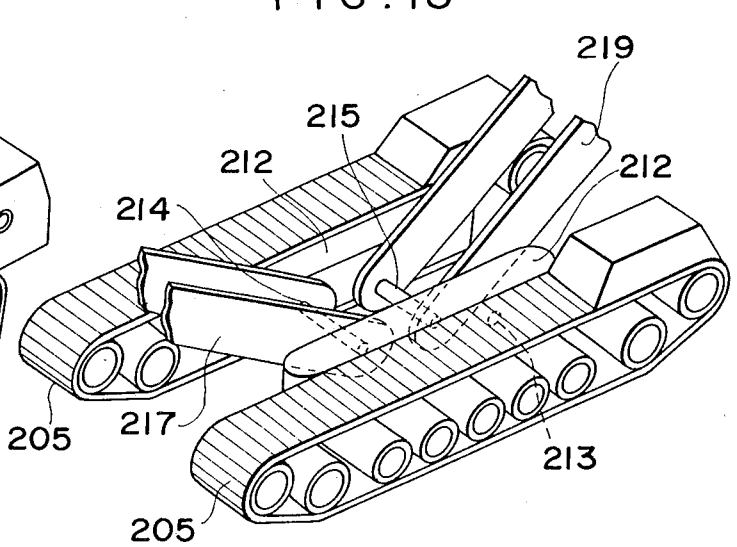
FIG. 18 is a partial view showing a mounting mechanism of chassis on to wheel support members.
Figure 19:
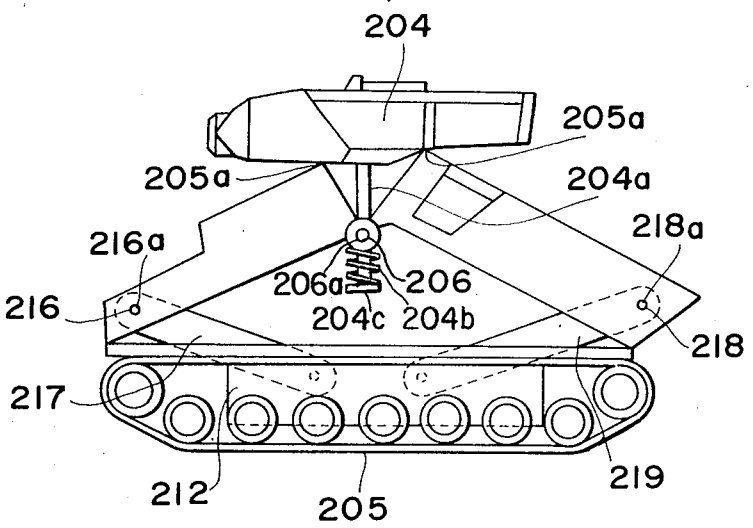
FIG. 19 illustrates how the front and rear compartments are folded down to form a trunk of the toy robot.

As shown in FIG. 18, the caterpillar 205 is coupled to a wheel support member 212 by means of an axle 213, thereby enabling the former to be turned about the axle 213. The wheel support member 212 is provided with a front connecting rod 214 and a rear connecting rod 215. These connection rods 214 and 215 are coupled respectively to the chassis comprising front and rear chassis 217 and 219, for pivotal movement of the chassis about the connection rods 214 and 215. One end of the front chassis 217 is pivotally connected to the front compartment through an axle **216*a* (FIG. 19). The axle 216*a* is fixedly inserted in a hole 216 formed on the front compartment 202. Similarly as shown in FIG. 19, one end of the rear chassis 219 is pivotally connected to the rear compartment through an axle 218*a*. The axle 218*a* is fixedly inserted in a hole 218 formed on the rear compartment 203**.

Figure 20:
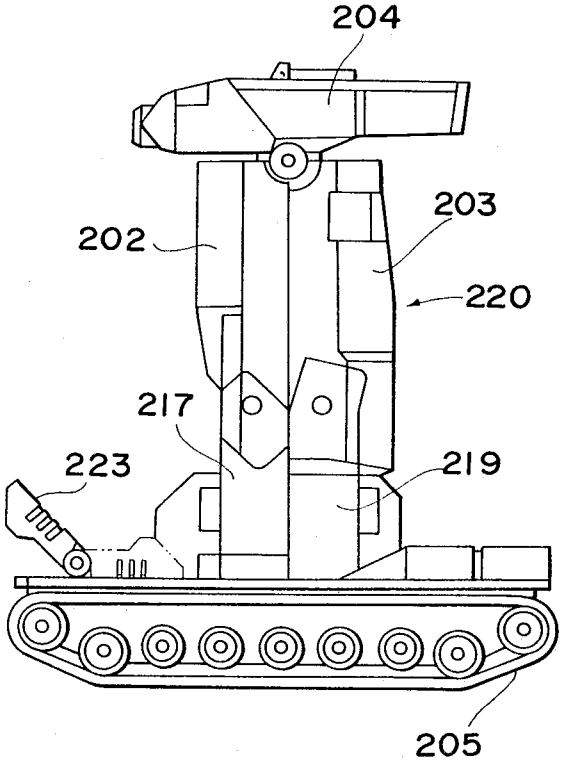
FIG. 20 is a side elevational view showing the toy robot in which the chassis and the compartments are folded and a foot is raised.

A pivotal member 206 is an axle 206 which is inserted into and between both side plates **206*a* of the front and rear compartments 202 and 203. Each one of the side plates 206*a* is of a circular plate extending at the bottom corner of the compartment toward the other one and a pair of side plates 206*a* are coupled through axle 206. Thus, by lifting up both front and rear chassis 217 and 219, both compartments 202 and 203 can be folded about the axle 206 to form a trunk portion 221 of the robot body 220 as shown in FIG. 20. A reference number 223 designates a foot mounted on the upper surface of the caterpiller 205**.

The middle compartment 204 which serves to represent a head portion of the toy robot as particularly shown in FIG. 19, is mounted upon both compartment 202 and 203 by means of a shaft **204*a* and a coil spring 204*b*. More particularly the shaft 204*a* is fixedly connected at one end thereof to the bottom of the middle compartment 204, and is provided with a projecting rim 204*c* at the other end thereof. The coil spring is mounted around the shaft 204*a* between the projecting rim and the rear lateral bottom sides of the front and rear compartments 202 and 203. Thus, the middle compartment 204 can be resiliently held upon the rear lateral top sides 205*a* with the help of the resilient force of the coil spring which pulls by abutting one end of the coil spring to the rear lateral bottom sides, the middle compartment 204 upon the top sides 205*a***.

The operation of the transformable toy vehicle thus constructed will now be described in conjunction with FIGS. 19 to 23, wherein the conversion from the toy battle tank into the toy robot is carried out.

Figure 23:
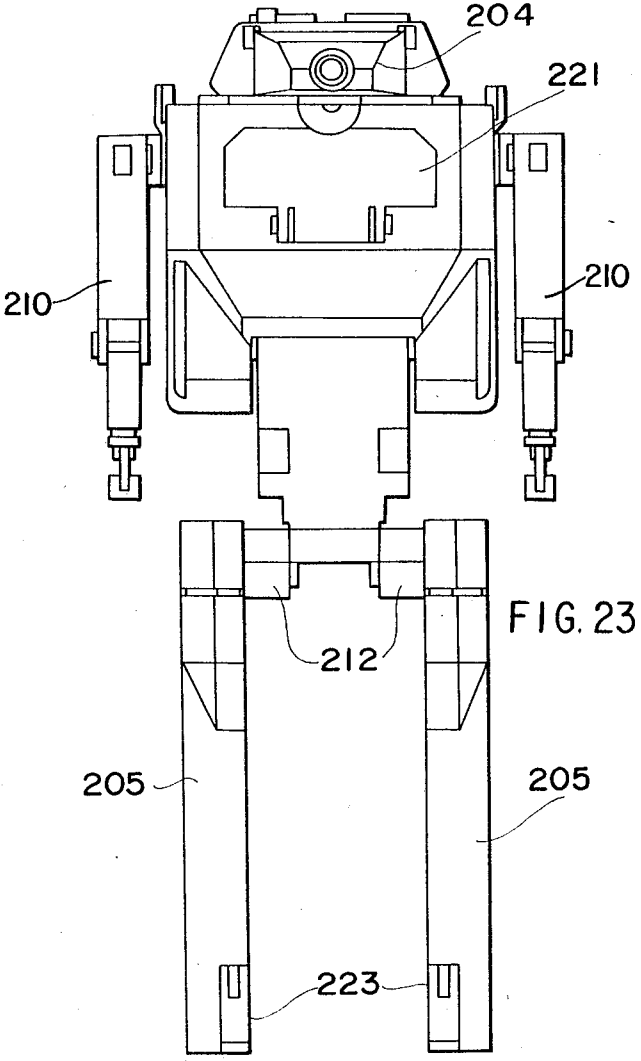
FIG. 23 is a front elevational view completely changed into a toy robot from its original battle tank of the fifth embodiment shown in FIG. 16.
Figure 21:
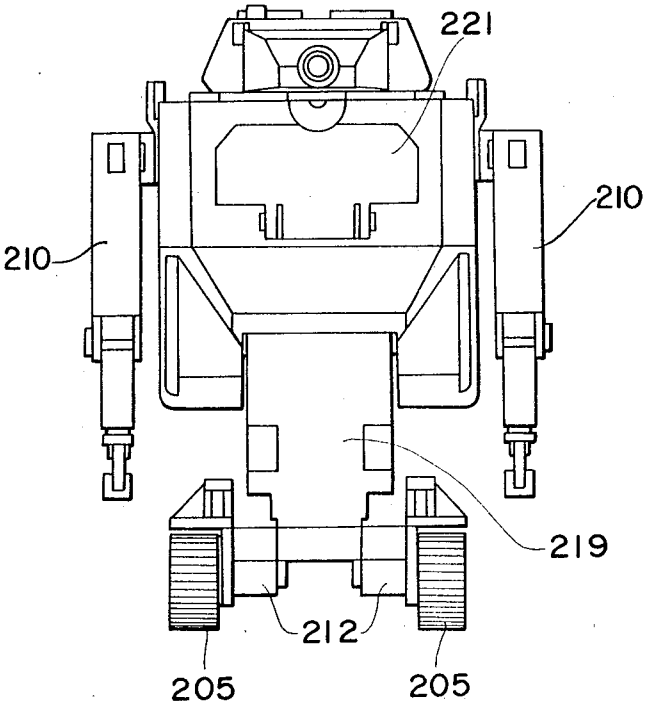
FIG. 21 is a front elevational view of the toy robot in which the arms are pulled out, the compartments are folded, and the chassis are made upright.
Figure 22:
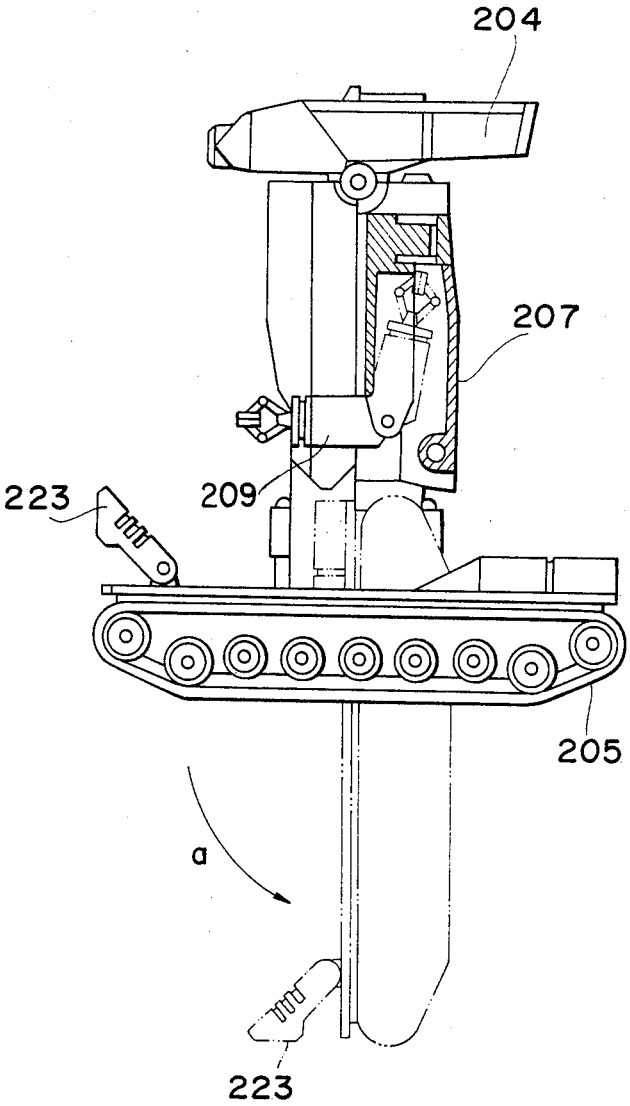
FIG. 22 is a side elevational view of the toy robot in which the arms are bent and in which stretching operation of the legs is illustrated by a phantom line.

First, the cannon 222 removably mounted on the middle compartment 204 is taken off. By pushing the front and rear compartments 202 and 203 toward inside relative to each other, both compartments can be folded around the axle 206, and are lifted above the caterpillar as shown in FIG. 19, and finally are transformed into the posture as shown in FIG. 20. Thus, the trunk portion 221 of the toy robot 220 is attained. The middle compartment 204 rests upon the front and rear compartments 202 and 203 to simulate the head portion of the toy robot 220. Thereafter, the lid 207 is opened to pull out the arm support member 208 by turning it around the axle 211. In this condition, the posture of the toy robot obtained is that of as shown in FIG. 21. Next, the caterpillar 205 is rotated about the axle 213 as shown by an arrow a of FIG. 22 to thereby obtain the posture shown by a phantom line of FIG. 22, with the foot 223 raised up. The finished standing posture of the toy robot is shown in FIG. 23. The inverse transformation of the toy robot into the original toy vehicle can be carried out by reversing the above described form conversion operation.

In the above embodiment, it is to be understood that although the arm support member 208 is housed in the recess of the rear compartment, it is not to be limited to such arrangement and the arm support member can be housed in the front compartment.

It is seen from the above description that the change of the outer appearance is appreciable and there is nothing which gives impression of the original outer appearance. This is due mainly from the fact that the trunk of the toy robot is made from the front and rear compartments. The quite different postures enhance its play value, but the toy vehicle comprises a relatively small number of components, which is obviously advantageous for production and assembly.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A transformable toy vehicle capable of being converted into a toy robot comprising;

a body having front, middle, and rear compartments;

a chassis for supporting said front and rear compartments and having front and rear vehicle wheels thereupon;

pivotal means for rotating said front and rear compartments relative to each other to form a trunk body of said robot and for mounting said middle compartment to form a head portion of said robot; and front and rear wheel support members pivotally connected to said chassis for rotatably bearing said wheels, said front wheel support member being provided with arms means, and said rear wheel support member being provided with leg means, said arm and leg means being housed in respective recesses formed in said front and rear compartments for ejecting said arm and leg means therefrom to form arms and legs of said robot.

2. A transformable toy vehicle as set forth in claim 1, wherein said chassis is divided into front and rear chassis;

said pivotal means couples said front and rear chassis by means of a hinge joint;

said middle compartment is fixedly connected upon said pivotal means; and said wheel support members include a pair of front wheel support members and a pair of rear wheel support members, said front wheel support members are each connected to said front chassis and capable of being turned inside out for pulling out said arm means, each said arm means being connected to one of said front wheels for rotatable movement thereabout; and said rear wheel support members are each connected to said rear chassis and capable of being rotated frontside back along said rear compartment for pulling outside leg means, each said leg means being connected to one of said rear wheel support members for rotatable movement thereabout.

3. A transformable toy vehicle as set forth in claim 1, wherein said chassis is divided into front and rear chassis;

said pivotal means couples said front and rear chassis by means of a hinge joint;

said middle compartment is mounted upon said pivotal means for slidable movable engagement therewith;

said wheel support members include a pair of front wheel support members and a pair of rear wheel support members, said front wheel support members are each connected to said front chassis and capable of being turned inside out for pulling out said arm means from said recess, each said arm means being connected to one of said front wheel support members for rotatable movement thereabout; and said rear wheel support members are each connected to said rear chassis by means of an axle and capable of being rotated frontside back along said rear compartment, said leg means being rotatably connected to said axle and can be pulled out from said recess.

4. A transformable toy vehicle as set forth in claim 2, wherein said front and rear chassis are provided with coupling means which ensures a snap joint of both chassis when said front and rear compartments are rotated relative to each other.

5. A transformable toy vehicle as set forth in claim 3, wherein said front and rear chassis are provided with coupling means which ensures a snap joint of both chassis when said front and rear compartments are rotated relative to each other.

6. A transformable toy vehicle capable of being converted into a toy robot comprising;

a body having front, middle, and rear compartments;

a chassis for supporting said front and rear compartments and having vehicle wheels mounted thereon;

pivotal means about which said front and rear compartments can be rotated relative to each other to form a trunk body of said robot;

means coupled between said front and rear compartments for mounting said middle compartment which serves as a head portion of said robot;

wheel support members connected to said chassis for supporting said vehicle wheels, said vehicle wheels serving as legs of said robot when said vehicle wheels are turned about said support members; and arm support members which are mounted on one of said front and rear compartments, and are provided with respective arm means which are housed in a recess of said one of said front and rear compartments for ejecting said arm means therefrom to form arms of said robot.

7. A transformable toy vehicle as set forth in claim 6, wherein said chassis is divided into a front chassis and a rear chassis; and said pivotal means are coupled at the rear sides of said front and rear compartments, said front chassis is pivotally connected, at the one end thereof, to the front side of said front compartment, and said rear chassis is pivotally connected, at the one end thereof, to the front side of said rear compartment; and said front and rear chassis are pivotally connected, at the other end thereof, to said wheel support members.

8. A transformable toy vehicle as set forth in claim 7, wherein said arm support members are capable of being turned inside out for pulling out said arm means, said arm means being connected to said arm support members for rotational movement thereabout.

9. A transformable toy vehicle as set forth in claim 6, wherein said middle compartment mounting means comprises;

a shaft connected at one end thereof to said middle compartment and provided at the other end thereof with a projecting rim; and a coil spring mounted around said shaft between the inner surface of said projecting rim and the rear sides of said front and rear compartments for exerting spring force in order for forcible retaining of said middle compartment.

10. A transformable toy vehicle as set forth in claim 7, wherein said middle compartment mounting means comprises;

a shaft connected at one end thereof to said middle compartment and provided at the other end thereof with a projecting rim; and a coil spring mounted around said shaft between the inner surface of said projecting rim and the rear sides of said front and rear compartments for exerting spring force in order for forcible retaining of said middle compartment.

11. A transformable toy vehicle as set forth in claim 8, wherein said middle compartment mounting means comprises;

a shaft connected at one end thereof to said middle compartment and provided at the other end thereof with a projecting rim; and a coil spring mounted around said shaft between the inner surface of said projecting rim and the rear sides of said front and rear compartments for exerting spring force in order for forcible retaining of said middle compartment.

* * * * *